US009677549B2

(12) United States Patent
Bauck et al.

(10) Patent No.: US 9,677,549 B2
(45) Date of Patent: Jun. 13, 2017

(54) RECIPROCATING PUMP WITH ELECTRONICALLY MONITORED AIR VALVE AND PISTON

(75) Inventors: Mark L. Bauck, Coon Rapids, MN (US); Mark T. Weinberger, Mounds View, MN (US); Vu K. Nguyen, Brooklyn Park, MN (US); Christopher M. Lange, New Brighton, MN (US); Wade D. Palashewski, Andover, MN (US); David M. Behrens, Hopkins, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 297 days.

(21) Appl. No.: 12/498,074

(22) Filed: Jul. 6, 2009

(65) Prior Publication Data

US 2011/0002793 A1 Jan. 6, 2011

Related U.S. Application Data

(63) Continuation-in-part of application No. 11/996,402, filed as application No. PCT/US2006/028826 on Jul. 25, 2006, now abandoned.

(Continued)

(51) Int. Cl.
*F04B 49/00* (2006.01)
*F04B 9/123* (2006.01)

(Continued)

(52) U.S. Cl.
CPC ..... *F04B 9/123* (2013.01); *F04B 9/125* (2013.01); *F04B 9/1256* (2013.01); *F04B 49/03* (2013.01); *F04B 49/10* (2013.01)

(58) Field of Classification Search
CPC ..... F04B 9/125; F04B 9/1256; F04B 49/03; F04B 49/10; F16K 35/022; F16K 35/025

(Continued)

(56) References Cited

U.S. PATENT DOCUMENTS 3,726,185 A 4/1973 Orr
3,813,596 A * 5/1974 Hulls ..... 324/391

(Continued)

FOREIGN PATENT DOCUMENTS

CN 101233321 7/2008
EP 0279931 3/1992

(Continued)

OTHER PUBLICATIONS

Graco's NXT(R) Air Motor Manual 311238V.

(Continued)

*Primary Examiner* — Charles Freay
(74) *Attorney, Agent, or Firm* — Kinney & Lange, P.A.

(57) ABSTRACT

An air operated pump 10 uses a magnet 14 mounted in the valve cup 16 of the air motor 18 and two reed sensors 20 mounted in the valve cover 22 to monitor the speed and position of the valve 16. A solenoid 24 is mounted on the valve cover 22 and can be commanded to extend a plunger 26 into the valve cup 16 to stop valve movement and therefore the pump from running away A magnetoresistive sensor 34 is located in the center of the air motor 18 to precisely monitor the piston 36 position and with air valve sensors 20 provides the input necessary for precise control and diagnostics of the pump 10 and makes it suitable for metering and plural component application.

7 Claims, 7 Drawing Sheets

Related U.S. Application Data

(60) Provisional application No. 60/703,306, filed on Jul. 28, 2005, provisional application No. 60/704,290, filed on Aug. 1, 2005.

(51) Int. Cl.
*F04B 9/125* (2006.01)
*F04B 49/03* (2006.01)
*F04B 49/10* (2006.01)

(58) Field of Classification Search
USPC ..... 417/395, 398, 399, 46; 137/50, 47; 91/248
See application file for complete search history.

(56) References Cited

U.S. PATENT DOCUMENTS

| | | | | |
|---|---|---|---|---|
| 4,300,603 | A * | 11/1981 | Laub, III | 141/258 |
| 4,669,960 | A | 6/1987 | Allen, Jr. et al. | |
| 4,715,264 | A | 12/1987 | Stoll | |
| 4,756,669 | A | 7/1988 | Hata | |
| 4,806,915 | A | 2/1989 | Rasmussen | |
| 4,915,591 | A | 4/1990 | Funke | |
| 4,990,058 | A * | 2/1991 | Eslinger | 417/46 |
| 5,174,731 | A | 12/1992 | Korver | |
| 5,182,704 | A | 1/1993 | Bengtsson | |
| 5,259,731 | A | 11/1993 | Dindsa et al. | |
| 5,271,121 | A | 12/1993 | Dolegowski | |
| 5,272,647 | A | 12/1993 | Hayes | |
| 5,275,194 | A * | 1/1994 | Gray, Jr. | A62C 2/04 137/75 |
| 5,349,895 | A | 9/1994 | DiCarlo | |
| 5,360,445 | A | 11/1994 | Goldowsky | |
| 5,796,184 | A | 8/1998 | Kuhnl et al. | |
| 5,826,616 | A * | 10/1998 | Golden | 137/554 |
| 5,929,770 | A * | 7/1999 | Faita | 340/10.41 |
| 6,126,403 | A | 10/2000 | Yamada | |
| 6,152,172 | A * | 11/2000 | Christianson et al. | 137/554 |
| 6,152,702 | A | 11/2000 | Codina et al. | |
| 6,519,508 | B1 | 2/2003 | Saito | |
| 6,799,501 | B2 | 10/2004 | Yo et al. | |
| 6,871,299 | B2 | 3/2005 | Havekost et al. | |
| RE39,843 | E * | 9/2007 | Wineland | 324/262 |
| 2002/0188382 | A1 | 12/2002 | Sherwood | |
| 2003/0017055 | A1 | 1/2003 | Fong | |
| 2003/0170127 | A1 | 9/2003 | Muenzenmaier et al. | |
| 2003/0208305 | A1 | 11/2003 | Junk et al. | |
| 2003/0234050 | A1* | 12/2003 | Misumi | 137/554 |
| 2004/0013531 | A1 | 1/2004 | Curry et al. | |
| 2004/0115065 | A1 | 6/2004 | Du et al. | |
| 2005/0000772 | A1* | 1/2005 | Wohner | 192/30 W |
| 2005/0022660 | A1 | 2/2005 | Holland | |
| 2008/0092960 | A1* | 4/2008 | Manecke et al. | 137/554 |
| 2008/0240944 | A1 | 10/2008 | Arens | |

FOREIGN PATENT DOCUMENTS

| | | | |
|---|---|---|---|
| GB | 1187026 | | 4/1970 |
| GB | 1237701 | | 6/1971 |
| JP | 5125836 | | 3/1976 |
| JP | S5125836 | | 3/1976 |
| JP | 61178576 | | 8/1986 |
| JP | 61236903 | | 10/1986 |
| JP | 283385 | | 6/1990 |
| JP | 06014981 | | 2/1994 |
| JP | 08014435 | | 1/1996 |
| JP | 09002041 | | 1/1997 |
| JP | 09053402 | | 2/1997 |
| JP | 2000046504 | | 2/2000 |
| JP | 2000298030 | | 10/2000 |
| JP | 2001074129 | | 3/2001 |
| JP | 2001295802 | | 10/2001 |
| JP | 20010327500 | | 11/2001 |
| JP | 2003275335 | | 9/2003 |
| JP | 2004225620 | A | 8/2004 |
| JP | 2009503339 | | 1/2009 |
| KR | 20080038136 | A | 5/2008 |
| TW | 200726911 | | 7/2007 |
| WO | 9601384 | A1 | 1/1996 |
| WO | 2007016081 | A2 | 2/2007 |
| WO | 2007016151 | A2 | 2/2007 |
| WO | 2007016151 | A3 | 2/2007 |
| WO | 2007087030 | A1 | 8/2007 |

OTHER PUBLICATIONS

Graco's Xtreme Sprayer Brochure 300578.
Graco's Xtreme Sprayer Manual 311164.
Official Action, Russian Application No. 2008107573/06(008209), dated Jan. 18, 2009, 3 pages.
European Search Report, EP Application Serial No. 06774688.3-2315/1907806, dated Aug. 17, 2009, 8 pages.
European Search Report, EP Application Serial No. 10168311.8-2315, dated Nov. 3, 2010, 6 pages.
Correspondence regarding Office Action, Mexican Application No. MX/A/2008/001332, dated Apr. 25, 2011, 2 pages.
EP Communication, EP Application Serial No. 10168311.8-2315, dated Sep. 14, 2011, 4 pages.
English Translation of Office Action, Mexican Application No. MX/A/2008/001332, dated Jan. 5, 2012, 4 pages.
English Translation of Office Action, Mexican Application No. MX/A/2010/007441, dated May 13, 2013, 3 pages.
EP Communication, EP Application Serial No. 10168311.8-1608/2273114, dated Aug. 2, 2013, 4 pages.
English Translation of Office Action, Japanese Application No. 2010-150847, dated Dec. 10, 2013, 2 pages.
State Intellectual Property Office of People's Republic of China, First Office Action and Search Report, Application No. 201010193410.4 Jan. 6, 2014, 7 pages.
English Translation of Office Action and Search Report, Taiwan Application No. 095127524, dated Mar. 13, 2014, 4 pages.
English Translation of Official Action, Russian Application No. 2010132634 dated Apr. 18, 2014, 2 pages.
English Translation of Official Action, Russian Application No. 2010132634 dated May 15, 2014, 1 page.
State Intellectual Property Office of People's Republic of China, Second Office Action and Search Report, Application No. 201010193410.4 Aug. 22, 2014, 7 pages.
English Translation of Office Action, Japanese Application No. 2010-150847, dated Sep. 2, 2014, 1 page.
English Translation of Official Action, Russian Application No. 2010132634/06(046174) dated Oct. 14, 2014, 3 pages.
English Translation of Office Action and Search Report, Taiwan Application No. 099122005, dated Nov. 10, 2014, 3 pages.
First Examination Report, India Application No. 9870/DELNP/2007, dated Dec. 19, 2014, 2 pages.
English Translation of Office Action, Japanese Application No. 2008-524063, dated Aug. 9, 2011, 3 pages.
Korean Notice of Preliminary Rejection for Korean Patent Application No. 10-2010-0064583, dated Nov. 30, 2016.

* cited by examiner

| PICTURE | DIAGNOSTIC CODE | DIAGNOSTIC NAME | PICTURE | ALARM OR WARNING | TECHNICAL DESCRIPTION | CAUSES |
|---|---|---|---|---|---|---|
| | 1 | RUNAWAY | THE MOTOR IS IN RUNAWAY. THE CYCLE RATE IS TOO HIGH COMPARED TO THE DESIRED MAXIMUM CYCLE RATE. | ALARM | THE CURRENT PUMP SPEED EXCEEDED THE MAXIMUM CYCLE RATE FOR 5 CONSECUTIVE CYCLES. | PUMP IS RUNNING TOO QUICKLY. CAN OCCUR IF PISTON SEAL OR FOOT VALVE ERROR OCCURS. |
| | 5 | SOLENOID FAILURE | THE AIR MOTOR HAS DETECTED A RUNAWAY CONDITON, THE INTERNAL SOLENOID EXTENDED BUT FAILED TO ENGAGE THE VALVE CUP. | WARNING | OCCURS WHEN THE SOLENOID HAS BEEN EXTENDED BUT MOVEMENT STILL OCCURS. | SOLENOID PLUNGER DOES NOT ENGAGE SHUTTLE. |
| | 8 | SOLENOID NOT EXTENDED ERROR | THE AIR MOTOR HAS DETECTED A RUNAWAY CONDITON, BUT THE INTERNAL SOLENOID DID NOT EXTEND. | WARNING | OCCURS WHEN THE SOLENOID SHOULD HAVE BEEN EXTENDED BUT DOES NOT. | SOLENOID DOES NOT EXTEND. SOLENOID NOT CONNECTED. |
| | 6 | SOLENOID NOT RETRACTED ERROR | THE INTERNAL SOLENOID DID NOT RETRACT WHEN THE RUNAWAY CONDITION WAS CLEARED. MOST LIKELY OCCURS BECAUSE THE AIR VALVE IS STILL ON. | WARNING | OCCURS WHEN THE SOLENOID SHOULD HAVE RETRACTED BUT DOES NOT. MOST LIKELY CAUSED BY THE AIR VALVE BEING TURNED ON. | SOLENOID DOES NOT RETRACT. SOLENOID NOT CONNECTED. |
| | 2 | PISTON SEAL | THE PISTON SEAL IS WORN. | WARNING | THE UP STROKE PUMP SPEED IS TWICE AS FAST AS THE DOWN STROKE FOR 5 CONSECUTIVE CYCLES. | |
| | 3 | FOOT VALVE | THE FOOT VALVE SEAL IS WORN. | WARNING | THE DOWN STROKE PUMP SPEED IS TWICE AS FAST AS THE UP STROKE FOR 5 CONSECUTIVE CYCLES. | |
| | 7 | REED SENSOR ERROR | ONE OF THE REED SENSORS HAS FAILED. | WARNING | OCCURS WHEN ONE OF THE SENSORS IS SWITCHED 5 TIMES WITHOUT THE OTHER SENSOR BEING SWITCHED. | REED SENSOR DOES NOT OPERATE. REED SENSOR WIRE IS BROKEN OR DISCONNECTED. |
| | 4 | LOW BATTERY | THE BATTERY NEEDS TO BE REPLACED. | WARNING | OCCURS WHEN THE BATTERY LEVEL IS TOO LOW. | BATTERY VOLTAGE IS TOO LOW. |

*FIG. 6*

RECIPROCATING PUMP WITH ELECTRONICALLY MONITORED AIR VALVE AND PISTON

CROSS-REFERENCE TO RELATED APPLICATIONS

This application is a continuation-in-part of U.S. application Ser. No. 11/996,402, filed Jan. 22, 2008, which is a §371 National Phase filing of International PCT Application Serial No. PCT/US06/28826, filed Jul. 25, 2006, which claims the benefit of U.S. Application Ser. Nos. 60/703,306, filed Jul. 28, 2005 and 60/704,290 filed Aug. 1, 2005.

BACKGROUND ART

Air-operated reciprocating piston pumps are well known for the pumping of various fluids. Such pumps typically have mechanically or pneumatically operated air valves to control the flow of air to the two sides of the piston. Control of such pumps has traditionally been by monitoring and controlling the resulting fluid flow rather than the pump itself. Prior art devices such as Graco's EXTREME-MIX™ proportioner have monitored the position of the piston for purposes of control.

DISCLOSURE OF THE INVENTION

It is therefore an object of this invention to provide a system which allows enhanced monitoring and control of a reciprocating air motor so as to allow monitoring of piston position, cycle and flow rates, total cycles, runaway control and the ability to diagnose failing air motor and pump lower components.

The control uses a magnet mounted in the valve cup of the air motor and two reed sensors mounted in the valve cover to monitor the speed and position of the valve. A solenoid is mounted on the valve cover and can be commanded to extend a plunger into the valve cup to stop valve movement and therefore the pump from running away (typically caused by the fluid supply being empty.) The user interface comprises an LCD and buttons to set up and control the pump. The display can be toggled to display cycle rate, flow rate (in various units), total cycles and diagnostic errors. Setup parameters can include fluid units (quarts, liters, etc.) and the runaway set point.

The reed switches and magnets are located so as to detect when the air valve is at the extreme position of each stroke or in transition or both. The controller calculates the rate at which the motor is running by counting the opening and closing of the reed switches activated by the varying positions of the air valve. The controller then compares that rate to a pre-programmed value to determine if the air motor is in a runaway condition. The that condition is present, the controller activates the solenoid preventing changeover which stops the motor. This acts to prevent spilled fluid and/or pump damage.

A magnetoresistive sensor is located in the center of the air motor to precisely monitor the piston position. The data from this sensor in conjunction with that from the air valve sensors provides the input necessary for precise control and diagnostics of the pump and makes it suitable for metering and plural component application.

The controller of the instant invention can use information from the linear transducer for feedback to the air pressure (or fluid pressure if hydraulic) to control the flow volume and rate by controlling shaft displacement and velocity. This feedback may be used in either a simple meter dispense system with one fluid or a two (or more) component system where the feedback is used to maintain flow, pressure and ratio.

These and other objects and advantages of the invention will appear more fully from the following description made in conjunction with the accompanying drawings wherein like reference characters refer to the same or similar parts throughout the several views.

BRIEF DESCRIPTION OF DRAWINGS

FIG. 6 shows the diagnostic codes which may be obtained by sensing the sir valve.

BEST MODE FOR CARRYING OUT THE INVENTION

Figure 1:
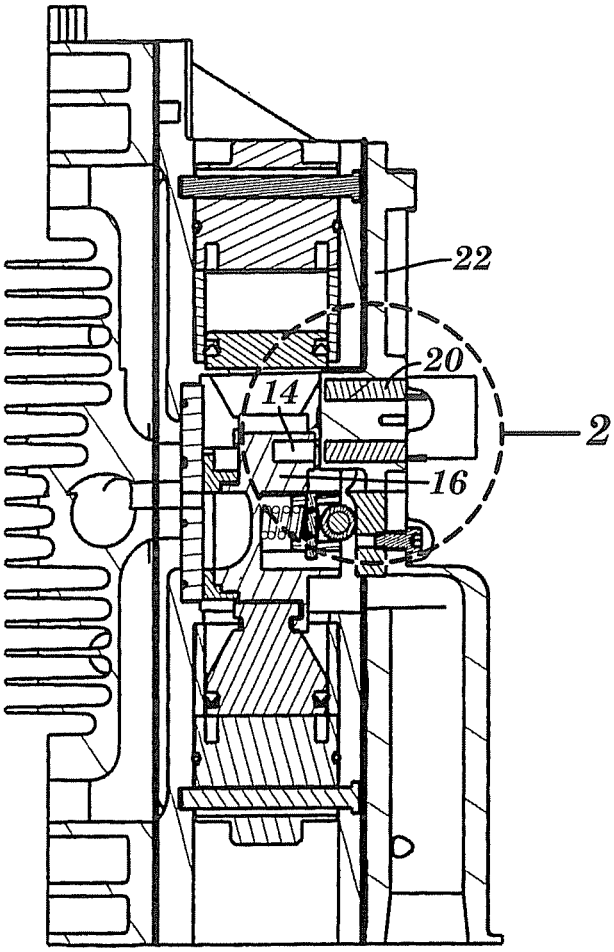
FIG. 1 shows a cross-section of the air valve as part of the instant invention showing the magnets and reed switches.
Figure 2:
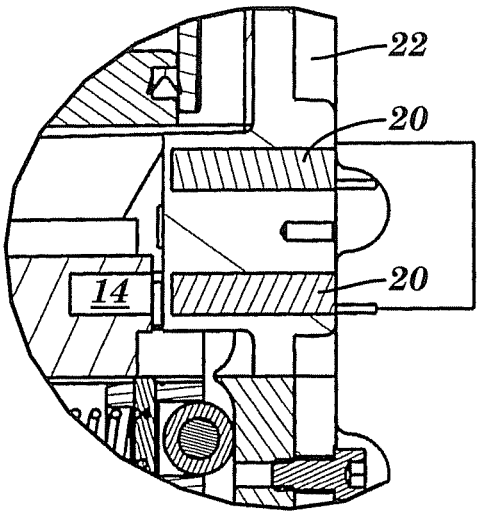
FIG. 2 shows a detail of the FIG. 1 cross-section of the air valve as part of the instant invention.
Figure 3:
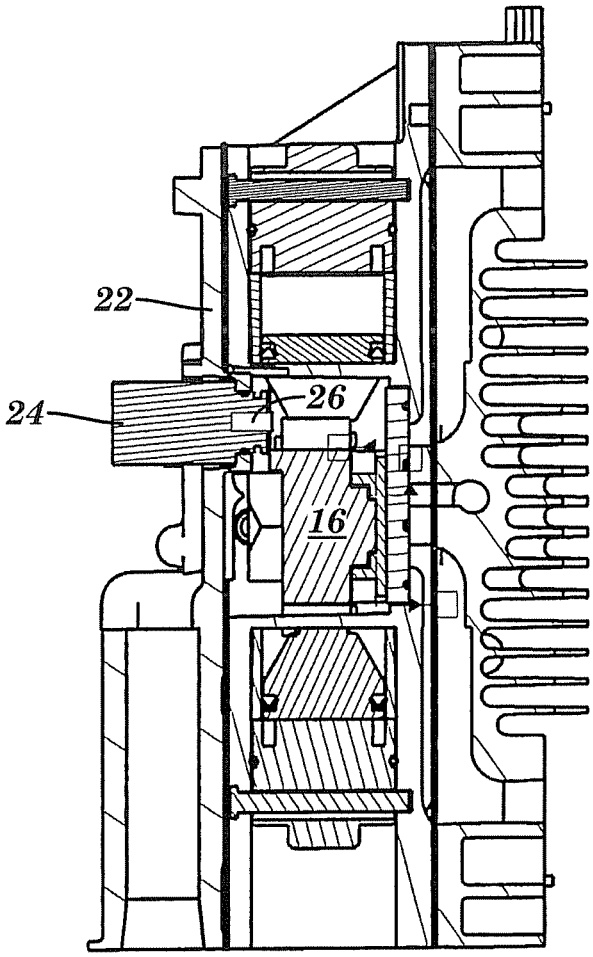
FIG. 3 shows a cross-section (opposite that of FIG. 1) of the air valve as part of the instant invention showing the solenoid.
Figure 4:
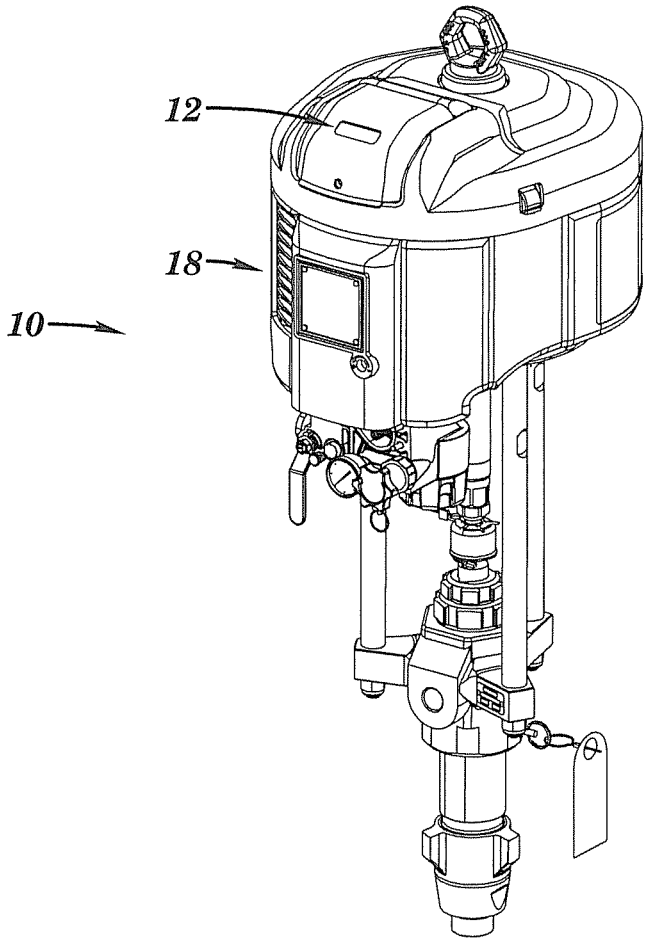
FIG. 4 shows a view of a pump incorporating the instant invention.
Figure 5:
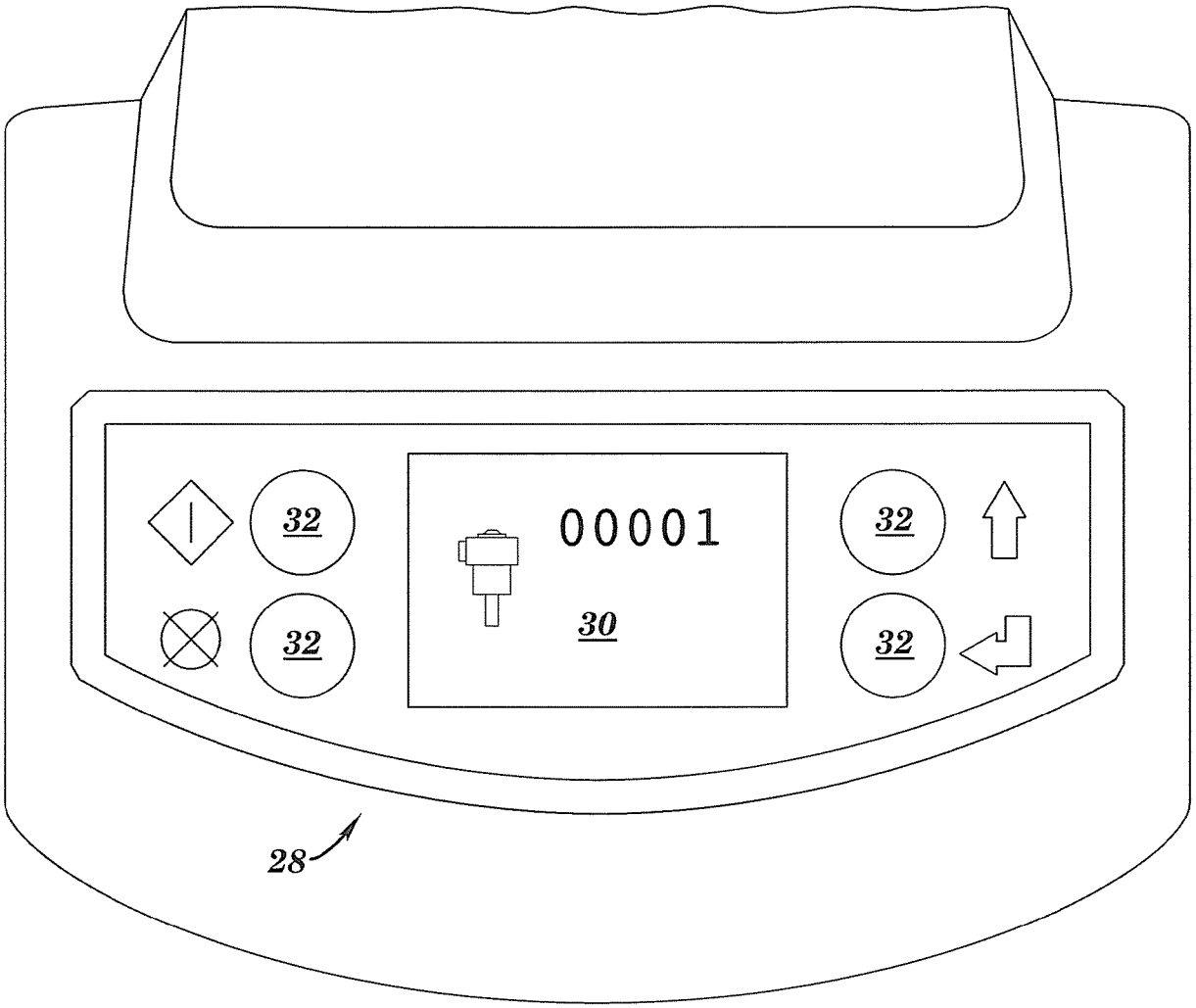
FIG. 5 shows a detail of the user interface of the instant invention.
Figure 7:
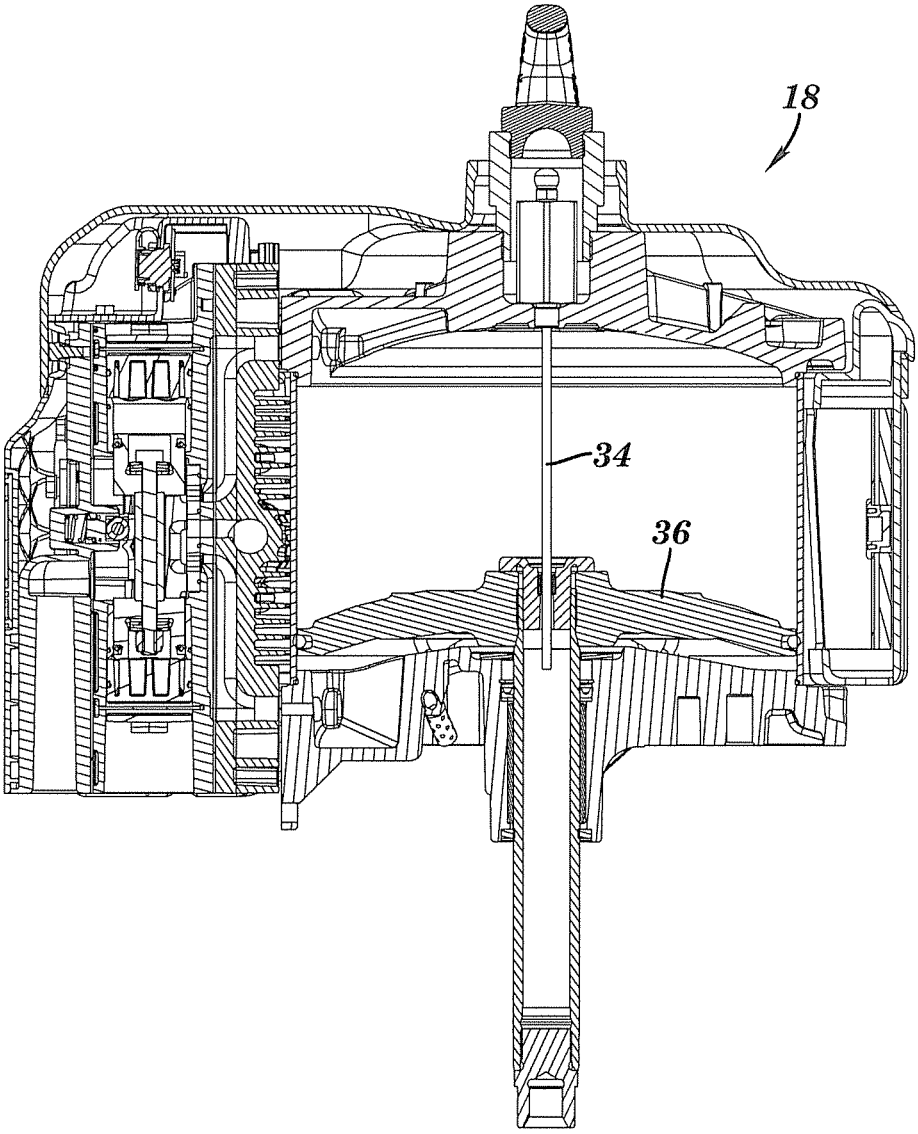
FIG. 7 shows the piston and magnetoresistive sensor.

In an air-operated reciprocating piston pump 10, the controller 12 uses a magnet 14 mounted in the valve cup 16 of the air motor 18 and two reed sensors 20 mounted in the valve cover 22 to monitor the speed and position of the valve 16. A solenoid 24 is mounted on the valve cover 22 and can be commanded to extend a plunger 26 into the valve cup 16 to stop valve movement and therefore the pump 10 from running away (typically caused by the fluid supply being empty or the hose of other supply conduit having a leak/rupture.) The user interface 28 comprises an LCD display 30 and buttons 32 to set up and control the pump 10. The display 30 can be toggled to display cycle rate, flow rate (in various units), total cycles and diagnostic errors. Setup parameters can include fluid units (quarts, liters, etc.) and the runaway set point.

The reed switches 20 and magnets 14 are located so as to detect when the air valve 16 is at the extreme position of each stroke or in transition or both. The controller 12 calculates the rate at which the motor 18 is running by counting the opening and closing of the reed switches 20 activated by the varying positions of the air valve 16. The controller 12 then compares that rate to a pre-programmed value to determine if the air motor 18 is in a runaway condition. The that condition is present, the controller 12 activates the solenoid 24 preventing changeover which stops the motor 18. This acts to prevent spilled fluid and/or pump damage.

A magnetoresistive sensor 34 is located in the center of the air motor 18 to precisely monitor the piston 36 position. The data from this sensor 34 in conjunction with that from the air valve sensors 20 provides the input necessary for precise control and diagnostics of the pump 10 and makes it suitable for metering and plural component application.

Figure 8:
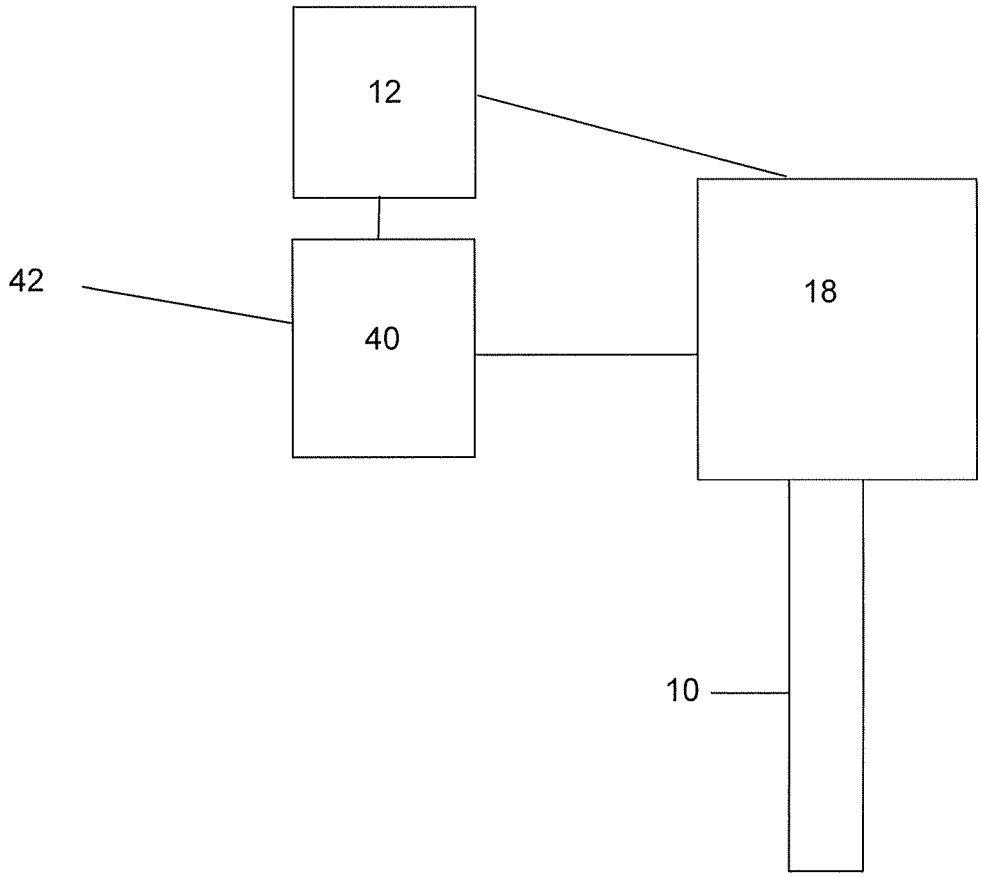
FIG. 8 shows a block diagram of the pump of the present invention.

The controller 12 of the instant invention seen in FIG. 8 can use information from the linear transducer for feedback to the air pressure (or fluid pressure if hydraulic) to control the flow volume and rate by controlling shaft displacement and velocity. Such can be done via an air pressure regulator 40 which modulates a supply 42 of pressurized air (or hydraulic fluid). This feedback may be used in either a simple meter dispense system with one fluid or a two (or more) component system where the feedback is used to maintain flow, pressure and ratio.

It is contemplated that various changes and modifications may be made to the pump control without departing from the spirit and scope of the invention as defined by the following claims.

The invention claimed is:

1. An air operated reciprocating piston pump comprising:

an air motor for driving the pump, the air motor having a piston;

a sensor comprising a linear transducer that monitors position of the piston in the air motor;

an air valve that controls flow of air to opposite sides of the piston of the air motor, the air valve including:

a valve cup;

a valve cover;

a magnet mounted in said valve cup of said air motor;

first and second reed sensors mounted in the valve cover to monitor the speed and position of the valve, wherein the first and second reed sensors and the magnet are located so as to detect when the air valve is at an extreme position of each stroke or in transition between extreme positions, or both;

a solenoid having a plunger and being mounted on said valve cover, said solenoid being capable of extending said plunger into said valve cup to stop valve movement and therefore the pump from running away;

a controller that calculates a rate at which the air motor is running based on opening and closing of the first and second reed sensors activated by varying positions of the air valve, determines whether the air motor is in a runaway condition, and activates the solenoid to extend the plunger into the valve cup to stop valve movement and thereby stop the air motor when the controller determines that a runaway condition is present.

2. The air operated reciprocating piston pump of claim 1 further comprising a user interface responsive to the controller to allow the display of various parameters based upon monitoring of the reed sensors by the controller.

3. The air operated pump reciprocating piston of claim 2 wherein said parameters include at least one of cycle rate, flow rate, total cycles and diagnostic errors.

4. The air operated reciprocating piston pump of claim 1 wherein said linear transducer comprises a magnetoresistive sensor.

5. The air operated reciprocating piston pump of claim 4 wherein said controller utilizes information from said linear transducer for feedback to an air regulator that modulates air pressure input to the air motor.

6. The air operated reciprocating piston pump of claim 5 wherein said controller controls pump flow volume based upon information from the linear transducer by controlling shaft displacement and velocity.

7. The air operated reciprocating piston pump of claim 5 wherein said controller controls pump flow rate based upon information from the linear transducer by controlling shaft displacement and velocity.

* * * * *